US012564875B2

(12) United States Patent
Akagane

(10) Patent No.: US 12,564,875 B2
(45) Date of Patent: Mar. 3, 2026

(54) METHOD OF MANUFACTURING ULTRASONIC TREATMENT TOOL

(71) Applicant: OLYMPUS CORPORATION, Hachioji (JP)

(72) Inventor: Tsunetaka Akagane, Hachioji (JP)

(73) Assignee: OLYMPUS CORPORATION, Tokyo (JP)

( * ) Notice: Subject to any disclaimer, the term of this patent is extended or adjusted under 35 U.S.C. 154(b) by 871 days.

(21) Appl. No.: 17/873,358

(22) Filed: Jul. 26, 2022

(65) Prior Publication Data

US 2022/0355364 A1 Nov. 10, 2022

Related U.S. Application Data

(63) Continuation of application No. PCT/JP2020/002846, filed on Jan. 27, 2020.

(51) Int. Cl.

| | |
|---|---|
| ***B21K 5/00*** | (2006.01) |
| ***B24C 1/08*** | (2006.01) |
| ***B24C 11/00*** | (2006.01) |

(52) U.S. Cl.

CPC ..... *B21K 5/00* (2013.01); *B24C 1/086* (2013.01); *B24C 11/00* (2013.01)

(58) Field of Classification Search

CPC ..... B21K 5/00; B24C 1/086; B24C 11/00; A61B 17/32

See application file for complete search history.

(56) References Cited

U.S. PATENT DOCUMENTS

2005/0266680 A1* 12/2005 Daskal ..... A61B 17/3211 438/637

2009/0143806 A1 6/2009 Witt et al.

(Continued)

FOREIGN PATENT DOCUMENTS

| | | | |
|---|---|---|---|
| JP | S58-175681 A | | 10/1983 |
| JP | H03-122205 A | | 5/1991 |
| JP | H06-057388 A | | 3/1994 |
| JP | 2010184079 A | * | 8/2010 |

(Continued)

OTHER PUBLICATIONS

Mamdeov et.al., Investigation of Mechanical and Microstructural Properties of Ti-6AI-4V Alloy Depending on Hot Forging Process Parameters, Procedia Engg., vol. 207,2017, p. 2155-2160. (Year: 2017).*

(Continued)

*Primary Examiner* — Jeffrey T Carley
*Assistant Examiner* — Jose K Abraham

(57) ABSTRACT

Provided is a method of manufacturing a vibration transmission member for an ultrasonic treatment tool. The method includes: applying a release agent between a surface of a vibration transmission member configured to transmit ultrasonic vibration and a die for hot forging; performing hot forging to form the vibration transmission member after the applying of the release agent; removing, after the performing of the hot forging, a part of an oxide film formed in the performing of the hot forging by a first surface treatment; performing pickling to remove the oxide film after the removing of the part of the oxide film by a blasting treatment; and performing coating with a resin after the performing of the pickling.

7 Claims, 9 Drawing Sheets

(56) References Cited

U.S. PATENT DOCUMENTS

| | | | | |
|---|---|---|---|---|
| 2014/0295209 | A1* | 10/2014 | Yao | C23C 18/04 428/141 |
| 2017/0143371 | A1 | 5/2017 | Witt et al. | |
| 2017/0143877 | A1 | 5/2017 | Witt et al. | |
| 2017/0196586 | A1 | 7/2017 | Witt et al. | |
| 2017/0196587 | A1 | 7/2017 | Witt et al. | |
| 2017/0202573 | A1 | 7/2017 | Witt et al. | |
| 2018/0153576 | A1* | 6/2018 | Akagane | A61B 18/14 |
| 2018/0263653 | A1 | 9/2018 | Witt et al. | |
| 2018/0289389 | A1 | 10/2018 | Witt et al. | |
| 2019/0239919 | A1 | 8/2019 | Witt et al. | |
| 2020/0046401 | A1 | 2/2020 | Witt et al. | |

FOREIGN PATENT DOCUMENTS

| | | | |
|---|---|---|---|
| JP | 2011-505198 | A | 2/2011 |
| JP | 2013-106635 | A | 6/2013 |
| WO | 2017/018190 | A1 | 2/2017 |

OTHER PUBLICATIONS

Jia et.al., Porosity, Microstructure, and Mechanical Properties of Ti-6Al-4V Alloy Parts Fabricated by Powder Compact Forging, Metallurgical and Materials Trans, A vol. 48A, Apr. 2017, p. 2015-2029. (Year: 2017).*

Mar. 24, 2020 International Search Report issued in International Patent Application No. PCT/JP2020/002846.

Mar. 24, 2020 Written Opinion issued in International Patent Application No. PCT/JP2020/002846.

* cited by examiner

METHOD OF MANUFACTURING ULTRASONIC TREATMENT TOOL

CROSS-REFERENCE TO RELATED APPLICATION

This application is a continuation of International Application No. PCT/JP2020/002846, filed on Jan. 27, 2020, the entire contents of which are incorporated herein by reference.

BACKGROUND

1. Technical Field

The present disclosure relates to a method of manufacturing an ultrasonic treatment tool.

2. Background

In the related art, an ultrasonic treatment tool including a vibration transmission member that transmits ultrasonic vibration is known.

Here, in a case where an oxide film is formed on the surface of the vibration transmission member (ultrasonic vibration probe), the black oxide film impairs the appearance quality of the vibration transmission member and eventually the ultrasonic treatment tool. When an oxide film is formed on the surface of the vibration transmission member, the oxide film is removed by pickling.

SUMMARY

In some embodiments, provided is a method of manufacturing a vibration transmission member for an ultrasonic treatment tool. The method includes: applying a release agent between a surface of a vibration transmission member configured to transmit ultrasonic vibration and a die for hot forging; performing hot forging to form the vibration transmission member after the applying of the release agent; removing, after the performing of the hot forging, a part of an oxide film formed in the performing of the hot forging by a first surface treatment; performing pickling to remove the oxide film after the removing of the part of the oxide film by a blasting treatment; and performing coating with a resin after the performing of the pickling.

In some embodiments, provided is a method of manufacturing an ultrasonic treatment tool. The method includes: applying a release agent between a surface of a vibration transmission member configured to transmit ultrasonic vibration and a die for hot forging; performing hot forging to form the vibration transmission member after the applying of the release agent; removing, after the performing of the hot forging, a part of an oxide film formed in the performing of the hot forging by a first surface treatment; performing pickling to remove the oxide film after the removing of the part of the oxide film by a blasting treatment; performing coating with a resin after the performing of the pickling; and assembling the vibration transmission member to a housing main body after the performing of the coating.

The above and other features, advantages and technical and industrial significance of this disclosure will be better understood by reading the following detailed description of embodiments of the disclosure, when considered in connection with the accompanying drawings.

DETAILED DESCRIPTION

Figure 1:
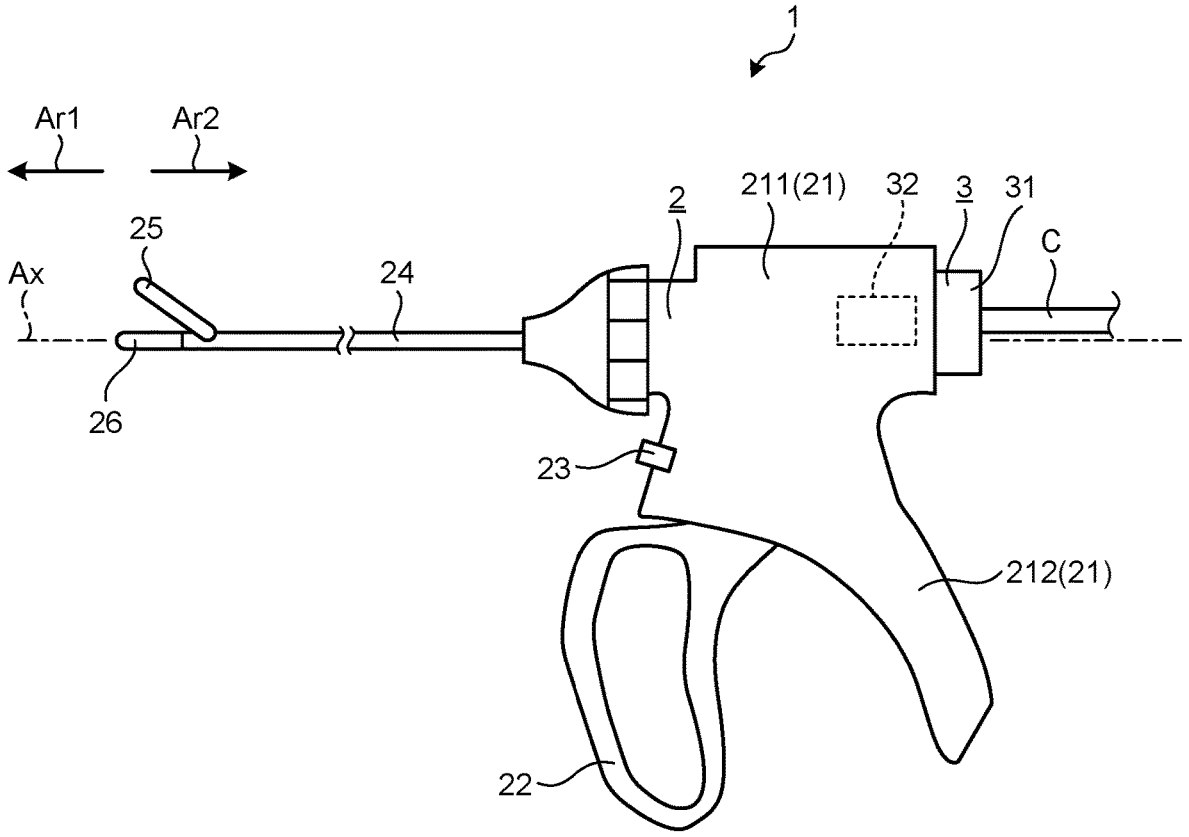
FIG. 1 is a view illustrating an ultrasonic treatment tool according to an exemplary embodiment.

Hereinafter, embodiments for carrying out the disclosure (hereinafter referred to as embodiments) will be described with reference to the drawings. Note that the disclosure is not limited by the embodiments described below. Moreover, in the description of the drawings, the same parts are denoted by the same reference numerals.

Configuration of Ultrasonic Treatment Tool

FIG. 1 is a view illustrating a configuration of an ultrasonic treatment tool 1 according to an exemplary embodiment.

Hereinafter, for convenience of description, one side along a central axis Ax of a sheath 24 is referred to as a distal end side Ar1, and the other side is referred to as a proximal end side Ar2 (FIG. 1).

The ultrasonic treatment tool 1 treats a region to be treated (hereinafter, described as a target region) by applying treatment energy to the target region in a living tissue. In the present embodiment, ultrasonic energy is employed as treatment energy. In addition, as the treatment, coagulation or incision of a target region can be exemplified. As illustrated in FIG. 1, the ultrasonic treatment tool 1 includes a handpiece 2 and an ultrasonic transducer 3.

As illustrated in FIG. 1, the handpiece 2 includes a housing 21, a movable handle 22, a switch 23, the sheath 24, a jaw 25, and a vibration transmission member 26.

The housing 21 supports the entire ultrasonic treatment tool 1. As illustrated in FIG. 1, the housing 21 includes a substantially cylindrical housing main body 211 coaxial with the central axis Ax, and a fixed handle 212 extending downward in FIG. 1 from the housing main body 211 and gripped by an operator.

The movable handle 22 is pivotally supported to the housing 21 so as to be rotatable about a rotation shaft (not illustrated) orthogonal to the paper surface of FIG. 1. The movable handle 22 receives an opening/closing operation by the operator. The opening/closing operation is an operation of rotating the movable handle 22 with respect to the housing 21.

As illustrated in FIG. 1, the switch 23 is provided in a state of being exposed to the outside from the side surface of the distal end side Ar1 of the fixed handle 212, and receives an output start operation by the operator. The output start operation is an operation of pressing the switch 23, and is an operation of starting application of ultrasonic energy to a target region. Then, the switch 23 outputs an operation signal corresponding to the output start operation to an external control device (not illustrated) via an electric cable C (FIG. 1).

The sheath 24 has a substantially cylindrical shape as a whole. The sheath 24 has an end portion on the proximal end side Ar2 attached to the housing main body 211.

The jaw 25 is rotatably attached to the end portion on the distal end side Ar1 of the sheath 24, and grips the target region between the jaw 25 and the end portion on the distal end side Ar1 of the vibration transmission member 26. Note that an opening/closing mechanism (not illustrated) that opens and closes the jaw 25 with respect to the end portion on the distal end side Ar1 of the vibration transmission member 26 according to the opening/closing operation to the movable handle 22 by the operator is provided inside the housing main body 211 and the sheath 24 described above.

The vibration transmission member 26 has an elongated shape extending along the central axis Ax, and is inserted into the sheath 24 in a state where the end portion on the distal end side Ar1 is exposed to the outside as illustrated in FIG. 1. Although not specifically illustrated, the end portion on the distal end side Ar1 of the vibration transmission member 26 is small and has a fine shape such as a curve in order to secure operability and visibility. Although not specifically illustrated, the jaw 25 has a shape corresponding to the end portion on the distal end side Ar1 of the vibration transmission member 26 in order to grip the target region with the end portion on the distal end side Ar1 of the vibration transmission member 26. In addition, the end portion on the proximal end side Ar2 of the vibration transmission member 26 is connected to a bolted Langevin transducer (BLT) 32 (FIG. 1) constituting the ultrasonic transducer 3. The vibration transmission member 26 transmits the ultrasonic vibration generated by the BLT 32 from the end portion on the proximal end side Ar2 to the end portion on the distal end side Ar1. In the present embodiment, the ultrasonic vibration is longitudinal vibration that vibrates in a direction along the central axis Ax. At this time, the end portion on the distal end side Ar1 of the vibration transmission member 26 vibrates with a desired amplitude by the longitudinal vibration of the vibration transmission member 26. That is, ultrasonic vibration is applied from the portion on the distal end side Ar1 of the vibration transmission member 26 to the target region gripped between the jaw 25 and the end portion on the distal end side Ar1 of the vibration transmission member 26. In other words, ultrasonic energy is applied to the target region from the end portion on the distal end side Ar1 of the vibration transmission member 26. As a result, frictional heat is generated between the end portion on the distal end side Ar1 of vibration transmission member 26 and the target region. Then, the target region is treated.

The ultrasonic transducer 3 is inserted into the housing main body 211 from the proximal end side Ar2 of the housing main body 211, and is detachably connected to the housing main body 211. The ultrasonic transducer 3 includes a TD case 31 constituting an exterior of the ultrasonic transducer 3, and the BLT 32 provided inside the TD case 31 and supplied with a drive signal that is AC power via the electric cable C. The BLT 32 generates ultrasonic vibration in response to the supply of the drive signal.

Method of Manufacturing Ultrasonic Treatment Tool

Figure 2:
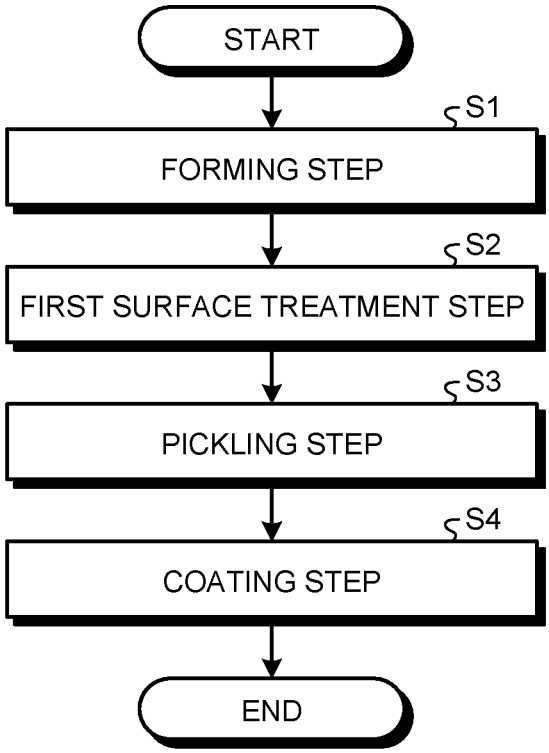
FIG. 2 is a flowchart illustrating a method of manufacturing an ultrasonic treatment tool.

FIG. 2 is a flowchart illustrating a method of manufacturing the ultrasonic treatment tool 1.

Hereinafter, for convenience of description, a method of manufacturing the vibration transmission member 26 will be mainly described as a method of manufacturing the ultrasonic treatment tool 1.

First, the operator performs a forming step described below (step S1).

As described above, the end portion on the distal end side Ar1 of the vibration transmission member 26 according to the present embodiment is small and has a fine shape such as a curve. Therefore, the vibration transmission member 26 needs to be made of a material having high strength. In addition, in a case where the material having high strength is used, if the vibration transmission member 26 is formed by cutting or the like, it takes time to perform the forming. Therefore, in the forming step S1, the vibration transmission member 26 is formed by hot forging.

Figure 3:
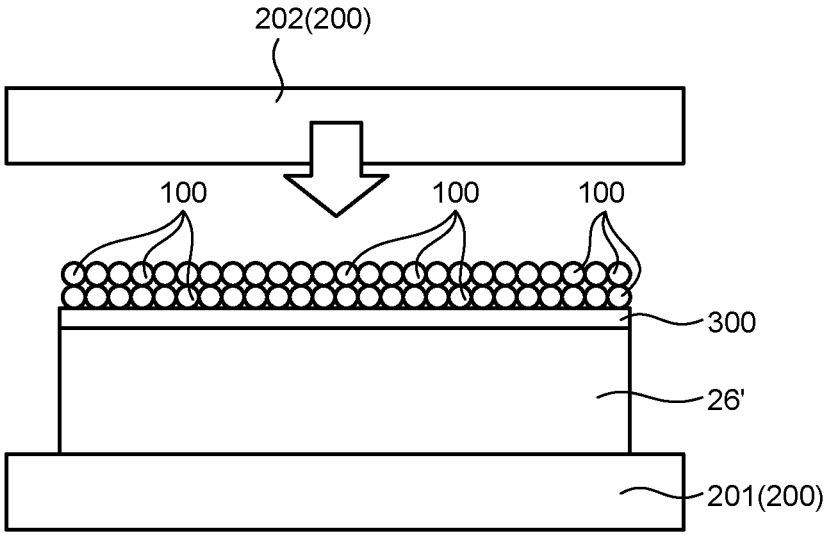
FIG. 3 is a view for explaining a forming step.
Figure 4:
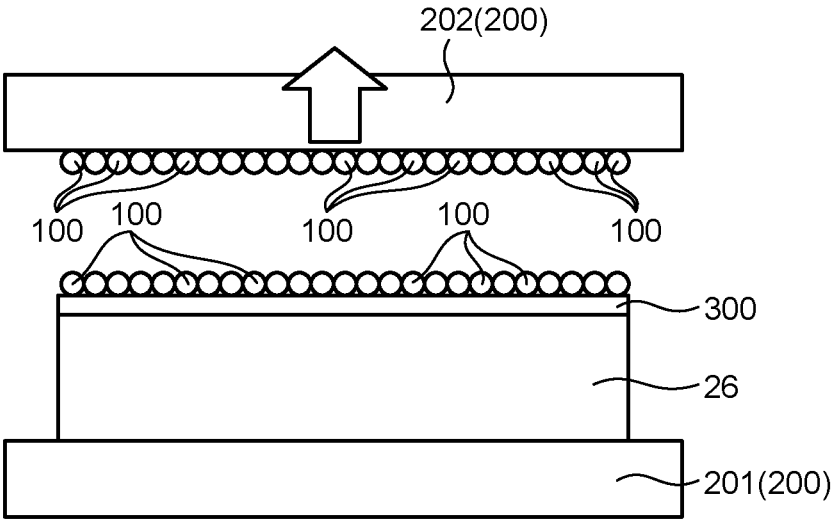
FIG. 4 is a view for explaining the forming step.
Figure 5:
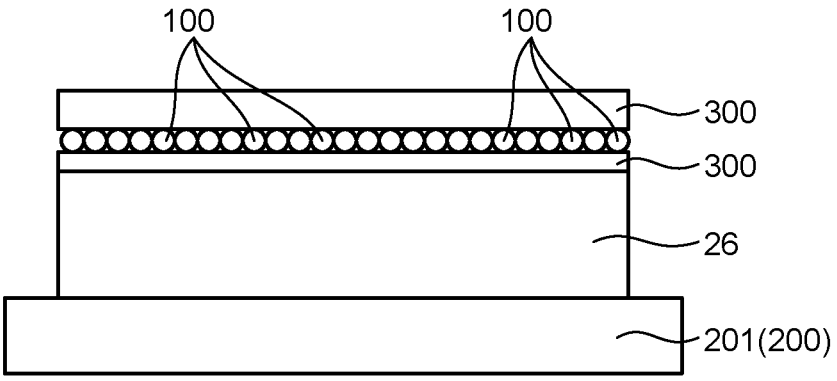
FIG. 5 is a view for explaining the forming step.

FIGS. 3 to 5 are views for explaining the forming step S1.

First, the operator charges a base material 26' of the vibration transmission member 26 into a heating furnace and heats the base material 26' to a specific temperature. Here, the base material 26' is made of Ti-6Al-4V which is a material having high strength. The specific temperature is a temperature within a range of 200° C. to 700° C.

Next, the operator applies a release agent 100 (FIG. 3) to the entire outer surface of the heated base material 26'. In FIG. 3, for convenience of description, the release agent 100 of only a part of the outer surface of the base material 26', of the release agent 100 applied to the entire outer surface of the base material 26', is illustrated. Here, the release agent 100 is molybdenum trioxide. However, the release agent 100 is not limited to molybdenum trioxide, and boron nitride, graphite, molybdenum dioxide, or the like may be employed.

Next, the operator places the base material 26' coated with the release agent 100 between a fixed die 201 and a movable die 202 constituting a die 200 used for hot forging (FIG. 3). The operator then applies pressure to the base material 26' between the fixed die 201 and the movable die 202 to form the vibration transmission member 26 (FIG. 4).

Here, when the die 200 is removed from the vibration transmission member 26, a part of the release agent 100 adheres to the die 200 side, and the rest remains on the surface of the vibration transmission member 26 (FIG. 4). In addition, since the hot forging is performed at a high temperature, an oxide film 300 formed on the entire surface of the vibration transmission member 26 is thickened after the forming step S1 (FIG. 5). That is, when not cutting but hot forging is adopted in the forming step S1, there is a problem in which the oxide film 300 is thickened. For convenience of description, FIGS. 3 to 5 illustrate the oxide film 300 of only a part of the outer surface of the vibration transmission member 26, of the oxide film 300 formed on the entire surface of the vibration transmission member 26.

After the forming step S1, the operator performs a first surface treatment step described below (step S2).

Figure 6:
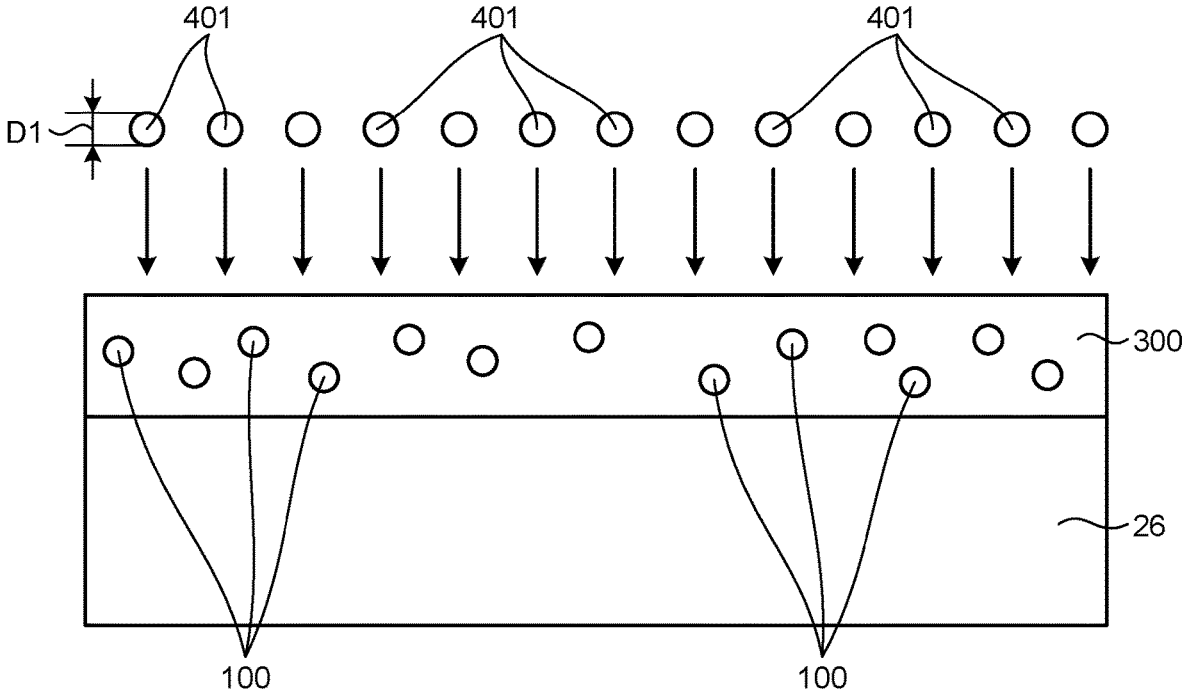
FIG. 6 is a view for explaining a first surface treatment step.
Figure 7:
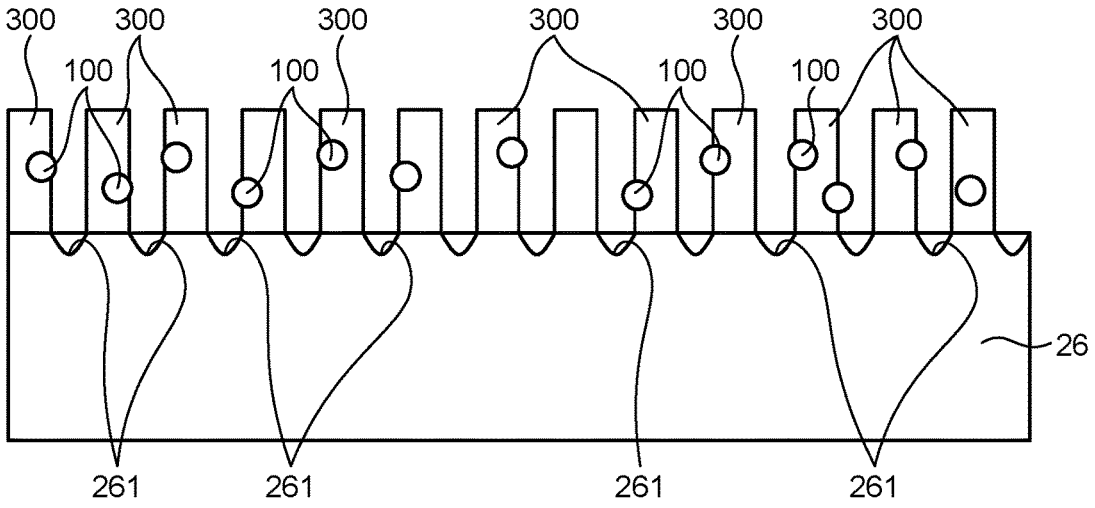
FIG. 7 is a view for explaining the first surface treatment step.

FIGS. 6 and 7 are views for explaining the first surface treatment step S2.

In the first surface treatment step S2 according to the present embodiment, as illustrated in FIG. 6, the surface of the vibration transmission member 26 is subjected to a blasting treatment using a first projection material 401 having a first diameter dimension D1. Here, as the first projection material 401, a projection material containing alumina as a main component (majority by mass %) can be exemplified. When the first surface treatment step S2 is performed, as illustrated in FIG. 7, a part of the oxide film 300 formed on the surface of the vibration transmission member 26 is removed by the first projection material 401, and a part of the surface of the vibration transmission member 26 is exposed. In addition, a first dent 261 is provided on the surface of the vibration transmission member 26 by the collision of the first projection material 401.

After the first surface treatment step S2, the operator performs a pickling step described below (step S3).

Figure 8:
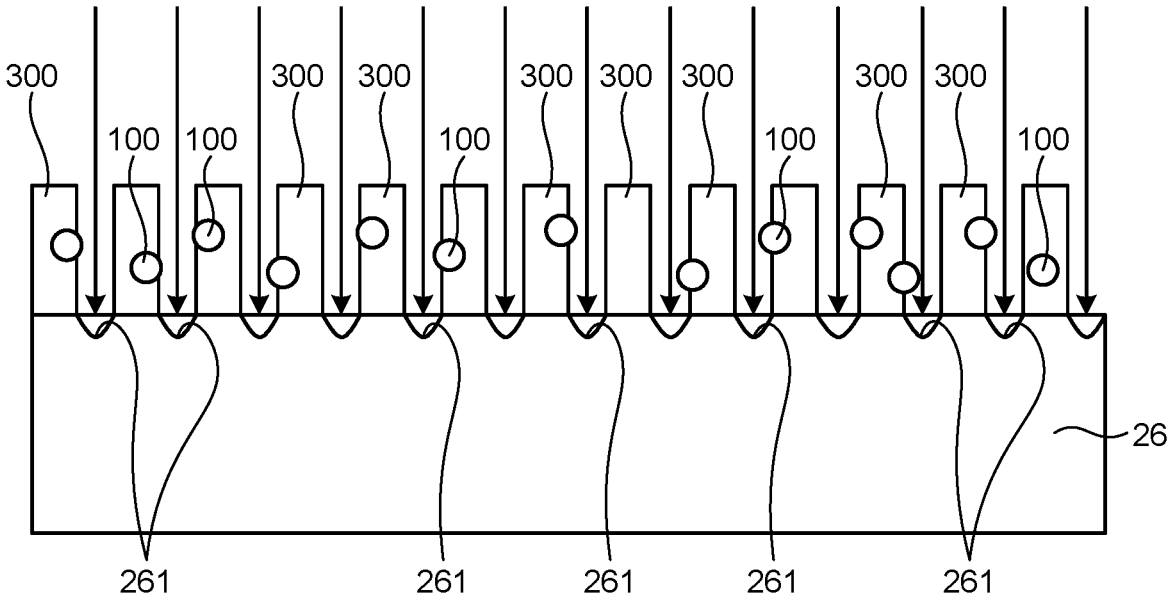
FIG. 8 is a view for explaining a pickling step.
Figure 9:
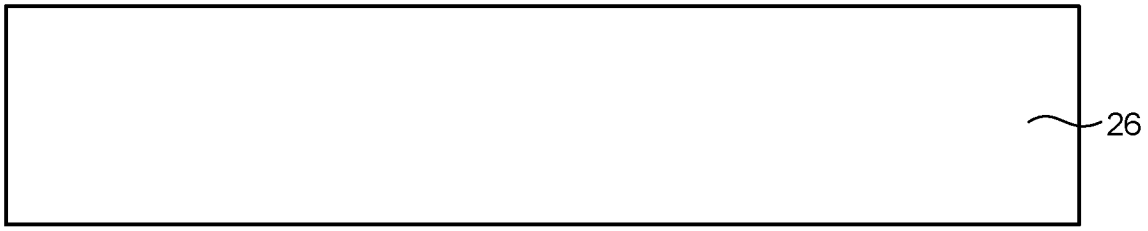
FIG. 9 is a view for explaining the pickling step.

FIGS. 8 and 9 are views for explaining the pickling step S3.

Specifically, the operator immerses the vibration transmission member 26 subjected to the first surface treatment step S2 in a pickling solution (for example, fluoronitric acid). As indicated by arrows in FIG. 8, the solution enters the gaps of the oxide film 300 removed by the first projection material 401, and acts between the surface of the vibration transmission member 26 and the contact surface of the oxide film 300. As a result, the oxide film 300 and the release agent 100 are removed from the surface of the vibration transmission member 26 as illustrated in FIG. 9. In addition, the first dent 261 formed on the surface of the vibration transmission member 26 in the first surface treatment step S2 is also removed. That is, the stress remaining on the surface of the vibration transmission member 26 is also released.

After the pickling step S3, the operator performs a coating step described below (step S4).

Figure 10:
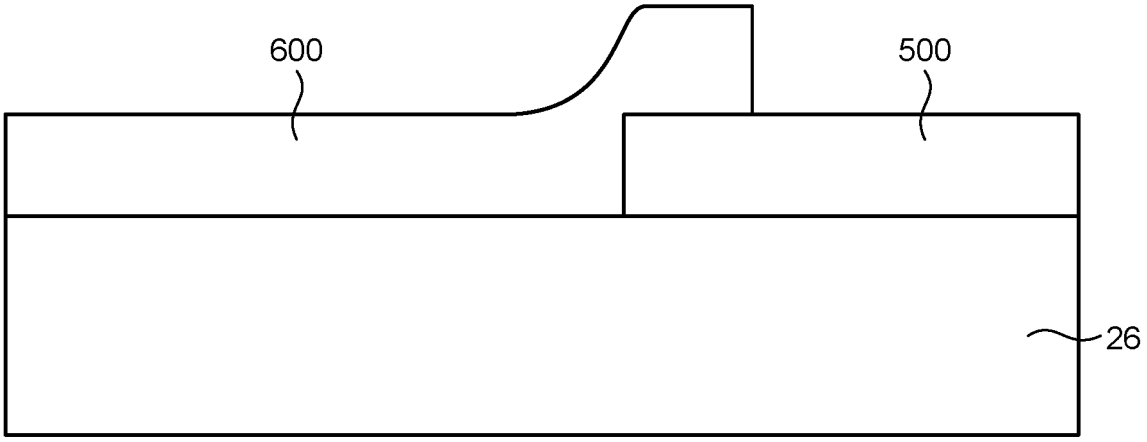
FIG. 10 is a view for explaining a coating step.
Figure 11:
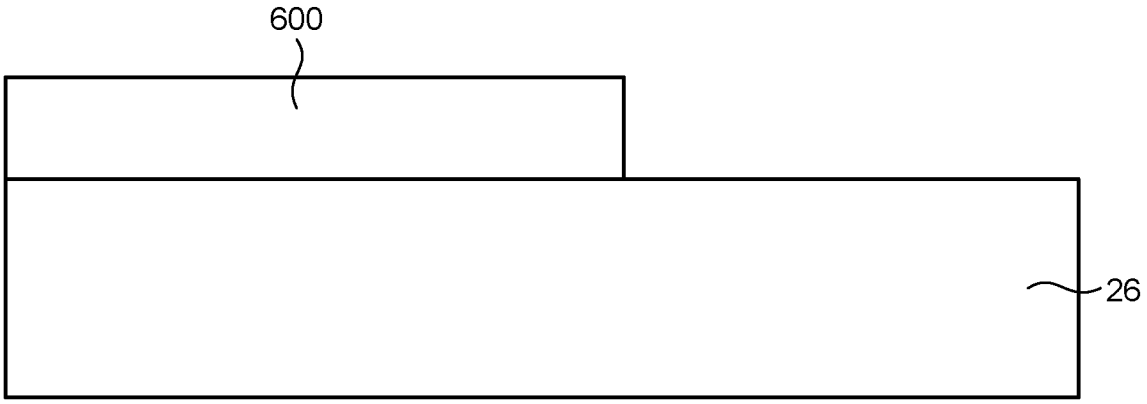
FIG. 11 is a view for explaining the coating step.

FIGS. 10 and 11 are views for explaining the coating step S4.

Specifically, the operator masks a non-coating region other than the region to be coated on the surface of the vibration transmission member 26 on which the pickling step S3 has been performed with a mask member 500 (FIG. 10). Here, the region to be coated is a region on the back surface side separated from the jaw 25 in the end portion on the distal end side Ar1 of the vibration transmission member 26.

Next, the operator coats the surface of the vibration transmission member 26 with a coating member 600 (FIG. 10). Here, as the coating member 600, poly ether ether ketone (PEEK) can be exemplified. As a method of forming the coating member 600, a method can be exemplified in which the coating member 600 is applied to the surface of the vibration transmission member 26 by spray application, and then sintered at a specific temperature.

Thereafter, as illustrated in FIG. 11, the operator removes the mask member 500 from the surface of the vibration transmission member 26.

According to the present embodiment described above, the following effects are obtained.

In the method of manufacturing the ultrasonic treatment tool 1 according to the present embodiment, by performing the first surface treatment step S2, a part of the oxide film 300 formed on the surface of the vibration transmission member 26 is removed, and a part of the surface of the vibration transmission member 26 is exposed. Then, after the first surface treatment step S2, the pickling step S3 is performed to allow the pickling solution to enter the gaps of the oxide film 300 and remove the oxide film 300.

That is, since the oxide film 300 is removed by performing both the first surface treatment step S2 and the pickling step S3, it is not necessary to increase the strength of pickling. Therefore, the shape of the vibration transmission member 26 itself is not broken by pickling.

Therefore, according to the method of manufacturing the ultrasonic treatment tool 1 according to the present embodiment, it is possible to improve the appearance quality by removing the oxide film 300 while maintaining the shape of the vibration transmission member 26 itself.

In particular, when the vibration transmission member 26 is formed by hot forging in the forming step S1, the oxide film 300 formed on the surface of the vibration transmission member 26 is easily thickened, but the oxide film 300 can be sufficiently removed by performing steps S2 and S3.

In addition, in the forming step S1, a release agent is applied between the die 200 and the base material 26' before hot forging is performed. Therefore, the formed vibration transmission member 26 can be easily removed from the die 200. Although the release agent 100 remains on the surface of the vibration transmission member 26 together with the oxide film 300, the release agent 100 can be removed together with the oxide film 300 by performing steps S2 and S3.

Moreover, the stress remaining on the surface of the vibration transmission member 26 is released by the pickling step S3.

EXAMPLES

Next, effects of the disclosure will be described based on specific examples.

First Example

In a first example, 30 vibration transmission members 26 are manufactured by the manufacturing method (steps S1 to S4) illustrated in FIG. 2. Hereinafter, for convenience of description, the 30 vibration transmission members 26 will be described as samples of the first example. The treatment time in first surface treatment step S2 (projection time of the first projection material 401) and the treatment time in the pickling step S3 (immersion time in the pickling solution) are as follows.

Treatment time in first surface treatment step S2: 60 seconds

Treatment time in pickling step S3: 10 seconds

First Comparative Example

In a first comparative example, 30 vibration transmission members 26 are manufactured by steps S1, S3, and S4 without performing the first surface treatment step S2 in the manufacturing method illustrated in FIG. 2. Hereinafter, for convenience of description, the 30 vibration transmission members 26 are described as samples of the first comparative example. The treatment time (immersion time in the pickling solution) in the pickling step S3 is as follows.

Treatment time in pickling step S3: 10 seconds

Second Comparative Example

In a second comparative example, 30 vibration transmission members 26 are manufactured by steps S1, S3, and S4 without performing the first surface treatment step S2 in the manufacturing method illustrated in FIG. 2. Hereinafter, for convenience of description, the 30 vibration transmission members 26 are described as samples of the second comparative example. The treatment time (immersion time in the pickling solution) in the pickling step S3 is as follows.

Treatment time in pickling step S3: 60 seconds

Third Comparative Example

In a third comparative example, 30 vibration transmission members 26 are manufactured by steps S1, S2, and S4 without performing the pickling step S3 in the manufacturing method illustrated in FIG. 2. Hereinafter, for convenience of description, the 30 vibration transmission members 26 are described as samples of the third comparative example. The treatment time (projection time of the first projection material 401) in the first surface treatment step S2 is as follows.

Treatment time in first surface treatment step S2: 60 seconds

Evaluation and Results

For each of the samples of the first example and the first to third comparative examples, the appearance, the molybdenum residue amount and the coating film formation failure rate shown below are evaluated. The results are as shown in Table 1 below.

Molybdenum Residue Amount

The molybdenum residue amount is measured as follows.

First, an etching solution (3M hydrofluoric acid/1M nitric acid mixed solution) is placed in a container, and a single vibration transmission member 26 of each sample of the first example and the first to third comparative examples is immersed for 100 seconds. After immersion, the single vibration transmission member 26 is taken out and washed with pure water. Then, the etching solution after immersing the single vibration transmission member 26 and the pure water after washing the single vibration transmission member 26 are combined, and the volume is fixed with pure water to prepare a test solution. Thereafter, the test sample is diluted, and the contents of "Ti" and "Mo" are measured by an inductivity coupled plasma atomic emission spectroscopy (ICP-AES) method. Then, the measured content of "Mo" per unit content of "Ti" is taken as the molybdenum residue amount. If the molybdenum residue amount is large, it means that a large amount of the release agent 100 and the oxide film 300 remain on the surface of the vibration transmission member 26.

The molybdenum residue amount shown in Table 1 below is an average value of the molybdenum residue amounts measured for the 30 vibration transmission members 26 for the sample of the first example. The same applies to the sample of the first to third comparative examples.

Coating Film Formation Failure Rate

The film formation failure of the coating member 600 is visually determined. Here, the film formation failure means film peeling of the coating member 600. In addition, the coating film formation failure rate means a ratio of the number of the coating members 600 having film formation failures among the 30 vibration transmission members 26 for the sample of the first example.

TABLE 1

| | Molybdenum residue amount | Coating film formation failure rate | Appearance |
|---|---|---|---|
| First example | 0.5 μg | 0% | The oxide film 300 can be removed. In addition, the fine shape of the vibration transmission member 26 is not broken and is maintained. |
| First comparative example | 1.0 μg | — | The oxide film 300 cannot be removed, and the entire surface of the transmission member 26 is black. |
| Second comparative example | — | — | The oxide film 300 can be removed, but the fine shape of the vibration transmission member 26 is broken |
| Third comparative example | 0.85 μg | 30% | The oxide film 300 cannot be partially removed, and the surface of the transmission member 26 is uneven. |

Results of First Comparative Example

In the first comparative example in which only the pickling step S3, of the first surface treatment step S2 (blasting treatment) and the pickling step S3, is performed for 10 seconds, as shown in Table 1, the oxide film 300 (including the release agent 100) cannot be removed. In the first comparative example, since it is confirmed that the oxide film 300 cannot be removed in the evaluation of the appearance, the coating film formation failure rate is not evaluated.

Results of Second Comparative Example

In the second comparative example in which only the pickling step S3, of the first surface treatment step S2 (blasting treatment) and the pickling step S3, is performed for 60 seconds, as shown in Table 1, the oxide film 300 (including the release agent 100) can be sufficiently removed, but the vibration transmission member 26 itself is melted, and the fine shape of the vibration transmission member 26 itself is broken. In the second comparative example, since it is confirmed that the fine shape of the vibration transmission member 26 itself is broken in the evaluation of the appearance, the molybdenum residue amount and the coating film formation failure rate are not evaluated.

Results of Third Comparative Example

In the third comparative example in which the blasting treatment, of the first surface treatment step S2 (blasting treatment) and the pickling step S3, is performed for 60 seconds, the oxide film 300 cannot be sufficiently removed as shown in Table 1. It is considered that since the oxide film 300 remains on the surface of the vibration transmission member 26, the coating film formation failure rate also reached a high value of 30%.

Results of First Example

In the first example in which both the first surface treatment step S2 (blasting treatment) and the pickling step S3 are performed, the oxide film 300 can be sufficiently removed as shown in Table 1. It is considered that since the oxide film 300 does not remain on the surface of the vibration transmission member 26, the coating film formation failure rate also is a low value of 0%.

Next, another exemplary embodiment will be described.

In the following description, the same reference numerals are given to the same configurations as those of the above-described embodiment, and the detailed description thereof will be omitted or simplified.

Figure 12:
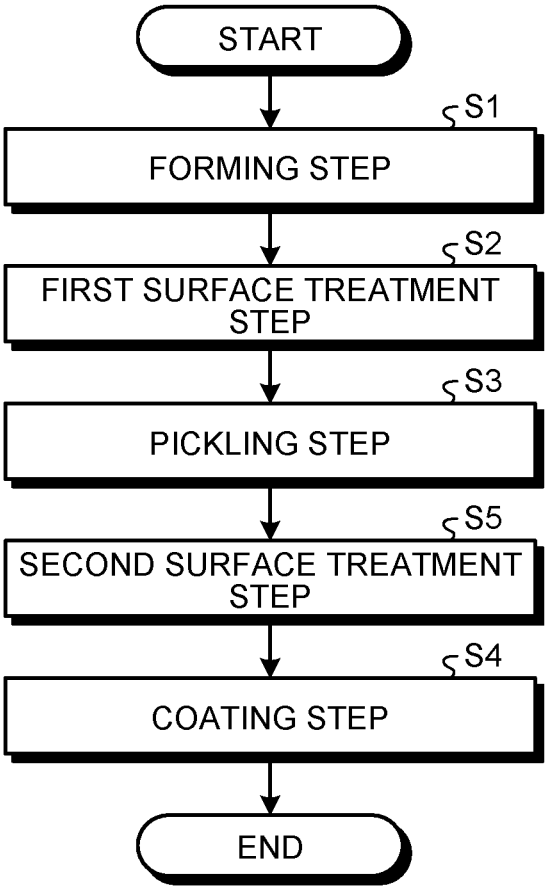
FIG. 12 is a flowchart illustrating a method of manufacturing an ultrasonic treatment tool according to an exemplary embodiment.

FIG. 12 is a flowchart illustrating a method of manufacturing the ultrasonic treatment tool 1 according to the present embodiment.

In the present embodiment, as illustrated in FIG. 12, a manufacturing method different from the manufacturing method (FIG. 2) of the ultrasonic treatment tool 1 described above is adopted.

In the method of manufacturing the ultrasonic treatment tool 1 according to the present embodiment, as illustrated in FIG. 12, a second surface treatment step S5 is added to the method of manufacturing the ultrasonic treatment tool 1 described in the above-described embodiment. Therefore, the second surface treatment step S5 will be mainly described below.

The second surface treatment step S5 is performed after the pickling step S3.

Figure 13:
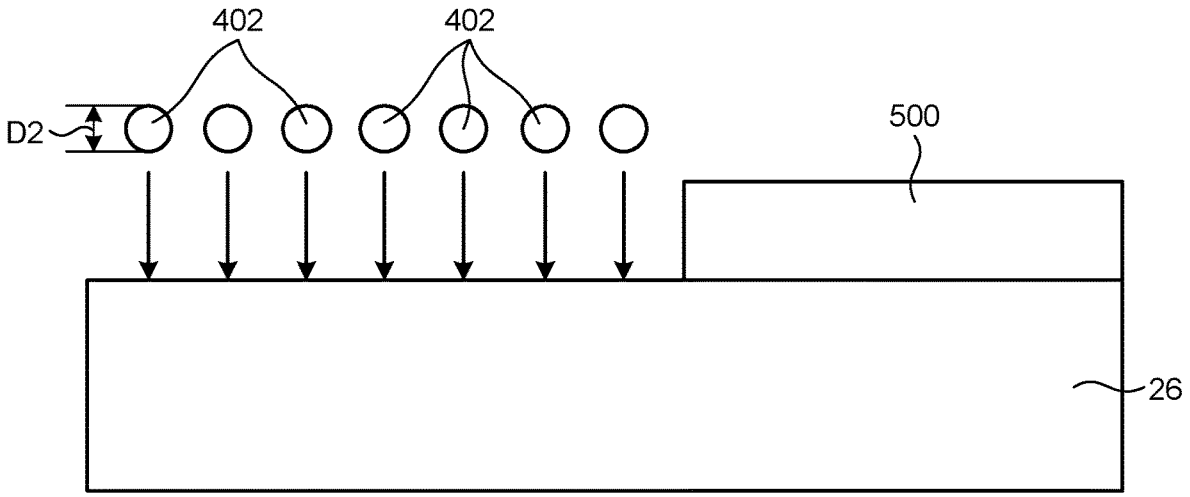
FIG. 13 is a view for explaining a second surface treatment step.
Figure 14:
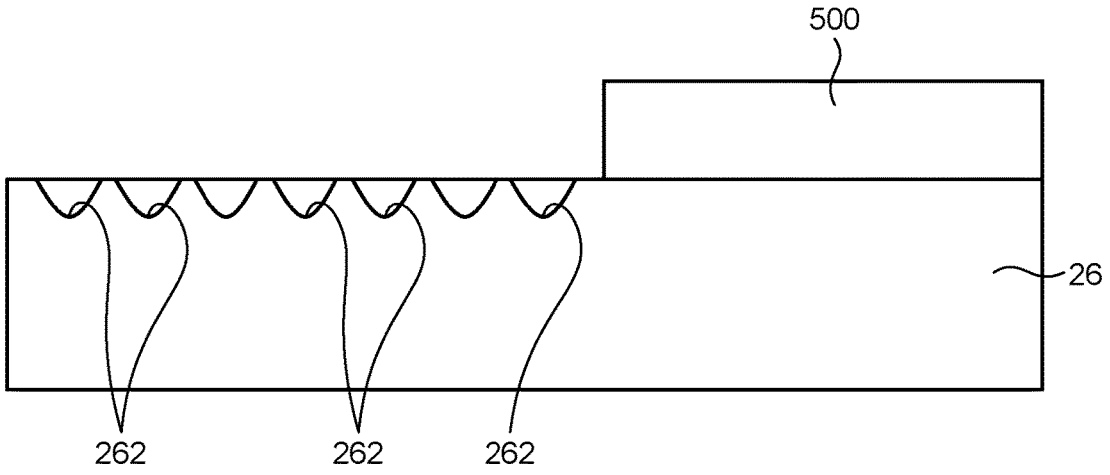
FIG. 14 is a view for explaining the second surface treatment step.

FIGS. 13 and 14 are views for explaining the second surface treatment step S5.

Specifically, the operator masks a non-coating region other than the region to be coated on the surface of the vibration transmission member 26 on which the pickling step S3 has been performed with the mask member 500 (FIG. 13). Here, the region to be coated is a region on the back surface side separated from the jaw 25 in the end portion on the distal end side Ar1 of the vibration transmission member 26.

Next, as illustrated in FIG. 13, the operator performs blasting treatment on the surface of the vibration transmission member 26 using a second projection material 402 having a second diameter dimension D2 larger than the first diameter dimension D1. Here, as the second projection material 402, a projection material containing alumina as a main component can be exemplified. Then, when the second surface treatment step S5 is performed, as illustrated in FIG. 14, a second dent 262 larger than the first dent 261 is provided by the collision of the second projection material 402 in a region (non-coating region) not masked by the mask member 500 on the surface of the vibration transmission member 26.

After the second surface treatment step S5, the coating step S4 is performed.

Figure 15:
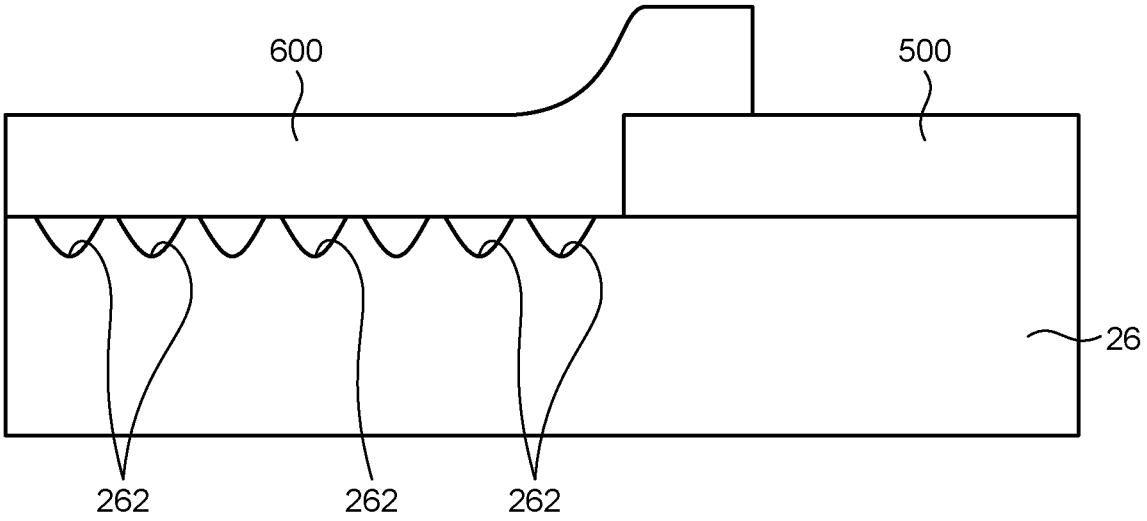
FIG. 15 is a view for explaining a coating step.
Figure 16:
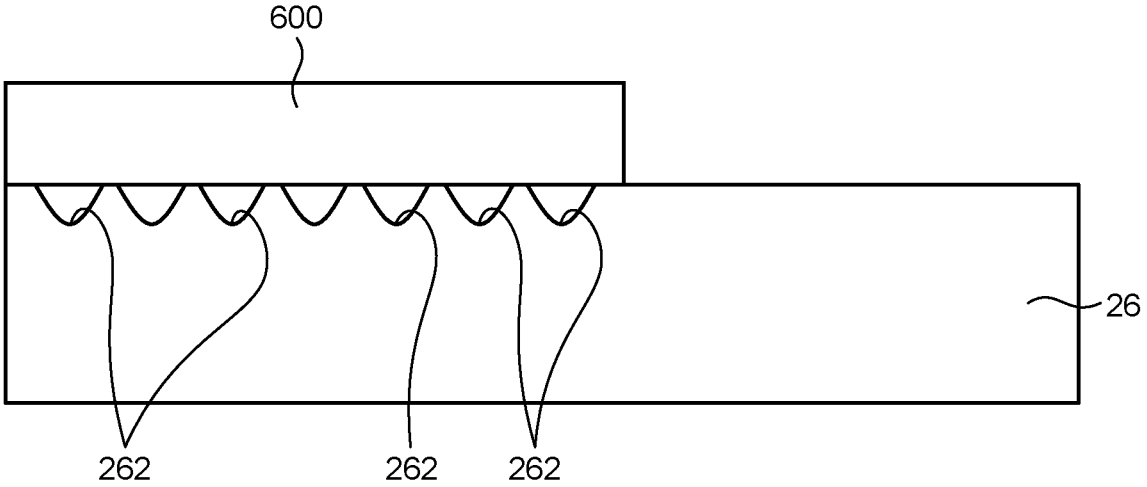
FIG. 16 is a view for explaining the coating step.

FIGS. 15 and 16 are views corresponding to FIGS. 10 and 11, respectively, and are views for explaining the coating step S4.

When the coating step S4 is performed, the coating member 600 comes into close contact with the surface of the vibration transmission member 26 in a state of entering the second dent 262 as illustrated in FIGS. 15 and 16.

According to the present embodiment described above, the following effects are obtained in addition to the same effects as those of the embodiment described above.

As described above, as the stress remaining on the surface of the vibration transmission member 26 is increased, adhesion of the coating member 600 to the surface of the vibration transmission member 26 is improved. Adhesion of the coating member 600 to parts of the surface of the vibration transmission member 26 having lower stress will be comparatively weaker. Therefore, in the coating step S4, even when the coating member 600 enters a gap between the surface of the vibration transmission member 26 and the mask member 500, and the coating member 600 adheres to a non-coating region other than the region to be coated on the surface of the vibration transmission member 26, the coating member 600 adhering to the non-coating region can be removed.

In the method of manufacturing the ultrasonic treatment tool 1 according to the present embodiment, the second surface treatment step S5 is performed between the pickling step S3 and the coating step S4.

Therefore, the stress remaining on the surface of the vibration transmission member 26 can be increased by the collision of the second projection material 402, and the adhesion of the coating member 600 to the surface of the vibration transmission member 26 can be improved.

Other Embodiments

Although the embodiments for carrying out the disclosure have been described so far, the disclosure should not be limited only by the above-described embodiments.

In the embodiments described above, the step of forming the vibration transmission member 26 by hot forging is adopted as the forming step S1, but the disclosure is not limited thereto. As the forming step according to the disclosure, for example, a step of forming the vibration transmission member 26 by cutting and then charging the vibration transmission member 26 into an atmospheric furnace and heating the vibration transmission member 26 in order to release the stress remaining on the surface of the vibration transmission member 26 may be adopted. In the forming step, the oxide film 300 formed on the surface of the vibration transmission member 26 is thickened by heating the vibration transmission member 26 in the atmospheric furnace, but the oxide film 300 can be sufficiently removed by performing steps S2 and S3.

In the embodiments described above, the blasting treatment is adopted as the first surface treatment step S2, but the disclosure is not limited thereto. As the first surface treatment step according to the disclosure, polishing treatment such as barrel polishing, laser processing, cutting treatment, or the like may be adopted as long as a part of the oxide film 300 formed on the surface of the vibration transmission member 26 can be removed to expose a part of the surface of the vibration transmission member 26. Similarly, the second surface treatment step S5 described in the embodiment of FIGS. 12-16 is not limited to the blasting treatment, and polishing treatment, laser processing, cutting treatment, or the like may be adopted.

In the embodiments described above, the configuration in which ultrasonic energy is applied to the target region is adopted as the ultrasonic treatment tool 1, but the disclosure is not limited thereto, and a configuration in which ultrasonic energy and at least one of high-frequency energy and thermal energy are applied to the target region may be adopted. Here, "applying high-frequency energy to the target region" means applying a high-frequency current to the target region. In addition, "applying thermal energy to the target region" means transmitting heat of a heater or the like to the target region.

According to a method of manufacturing an ultrasonic treatment tool according to the disclosure, it is possible to improve the appearance quality by removing the oxide film while maintaining the shape of the vibration transmission member itself.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing a vibration transmission member for an ultrasonic treatment tool, the method comprising, in order:

applying a release agent between a surface of a base material and a die for hot forging;

performing hot forging on the base material applied with the release agent to form the vibration transmission member, the vibration transmission member being configured to transmit ultrasonic vibration;

performing a first surface treatment, thereby removing a part of an oxide film formed on a surface of the vibration transmission member in the performing of the hot forging;

performing pickling to remove at least a part of a remainder of the oxide film that was not removed in the first surface treatment;

coating at least part of the surface of the vibration transmission member with a resin; and performing a second surface treatment after the performing of the pickling and before the coating, wherein:

the first surface treatment is a blasting treatment using a first projection material, the second surface treatment is a blasting treatment using a second projection material, and a diameter of the second projection material is larger than a diameter of the first projection material.

2. The manufacturing method according to claim 1, wherein the projection material comprises alumina as a main component.

3. The manufacturing method according to claim 1, wherein fluoronitric acid is used for the pickling.

4. The manufacturing method according to claim 1, wherein the vibration transmission member is made of Ti-6Al-4V.

5. The manufacturing method according to claim 1, wherein the resin comprises at least an ether group and a ketone group.

6. The manufacturing method according to claim 5, wherein the resin is poly ether ether ketone (PEEK).

7. A method of manufacturing an ultrasonic treatment tool, the method comprising, in order:

applying a release agent between a surface of a base material and a die for hot forging;

performing hot forging on the base material applied with the release agent to form a vibration transmission member, the vibration transmission member being configured to transmit ultrasonic vibration;

performing a first surface treatment, thereby removing a part of an oxide film formed on a surface of the vibration transmission member in the performing of the hot forging;

performing pickling to remove at least a part of a remainder of the oxide film that was not removed in the first surface treatment;

coating at least part of the surface of the vibration transmission member with a resin;

assembling the vibration transmission member to a housing main body; and performing a second surface treatment after the performing of the pickling and before the coating, wherein:

the first surface treatment is a blasting treatment using a first projection material, the second surface treatment is a blasting treatment using a second projection material, and a diameter of the second projection material is larger than a diameter of the first projection material.

* * * * *